US005974964A

United States Patent [19]

Adams

[11] Patent Number: 5,974,964

[45] Date of Patent: Nov. 2, 1999

[54] PRINTING METHOD

[76] Inventor: Randy L. Adams, 5007 Steffani Lane, Houston, Tex. 77041

[21] Appl. No.: 09/166,254

[22] Filed: Oct. 5, 1998

Related U.S. Application Data

[63] Continuation of application No. 07/848,643, Mar. 9, 1992, abandoned.

[51] Int. Cl.[6] ..... B41M 1/12

[52] U.S. Cl. ..... 101/129; 101/483

[58] Field of Search ..... 101/129, 483, 101/488, 487, 115, 114

[56] References Cited

U.S. PATENT DOCUMENTS

| | | | |
|---|---|---|---|
| 2,484,671 | 10/1949 | Bauman | 101/115 |
| 4,084,504 | 4/1978 | Fuchs | 101/115 |
| 4,474,109 | 10/1984 | Yara | 101/115 |
| 5,136,938 | 8/1992 | Pellegrina | 101/115 |
| 5,239,613 | 8/1993 | Motev et al. | 101/115 |
| 5,526,742 | 6/1996 | Petesen | 101/487 |

FOREIGN PATENT DOCUMENTS

| | | | |
|---|---|---|---|
| 0073669 | 3/1983 | European Pat. Off. | 101/129 |

*Primary Examiner*—Edgar Burr
*Assistant Examiner*—Anthony H. Nguyen
*Attorney, Agent, or Firm*—Harrison & Egbert

[57] ABSTRACT

An improved method of printing with a machine having at least one printing head and at least one platen registerable therewith. The method may include the steps of placing an article on the platen, bringing the platen and article into registerable contact with a printing screen supported at the printing head and transferring ink through the printing screen to the article after which the platen and article are separated from the printing screen. The method is improved by additional steps of extending a heating element into the space and directing heat toward the platen to cure the ink printed thereon.

7 Claims, 2 Drawing Sheets

PRINTING METHOD

RELATED APPLICATION

The present application is a continuation of U.S. patent application Ser. No. 07/848,643, filed Mar. 9, 1992 and entitled "IMPROVED PRINTING METHOD", now abandoned.

BACKGROUND OF THE INVENTION

1. Field of the Invention

The present invention pertains to methods of printing. More specifically, it pertains to an improved method of printing especially suitable for automatic printers with multiple printing stations.

2. Description of the Prior Art

The printing of paper textiles and other materials has been done, of course, in many ways over the centuries. In recent decades, the printing of paper posters and prints and textile articles such as blouses and shirts, with a myriad of designs, has become very popular. In such methods, the article to be printed in typically mounted on some sort of platen by which it is brought into contact with a mesh screen on which a particular print pattern is disposed. Some type of ink dispensing device is engaged with the screen and ink dispensed through the pattern for transfer to the article.

In recent years, printing of textile articles such as shirts and blouses has been done on a machine referred to as an automatic textile printer. These automatic textile printers usually have a frame about which is supported, perhaps on radial arms, a plurality of printing head each one of which may be capable of supporting a printing screen for engagement by an ink dispensing device. The frame of the automatic textile printer also supports a platen assembly which has a number of platens which are sequentially moveable into registration with usually adjacent ones of the printing heads. Typically, there are two more platens than the number of printing heads so that a textile article may be simultaneously placed on one and removed from another without interference from components at the printing heads.

In a typical method, a textile article is placed on a platen and the platen is moved into registration with one of the printing heads. After registration, the platen and textile article are brought into contact with a printing screen and a pattern is applied to the textile article by engaging the printing screen with an ink dispensing device after which the platen and textile article are separated from the printing screen.

If a design of more than one color is to be applied to the textile article, the platen and textile article may be moved into registration with another printing head, brought into contact with another printing screen supported thereby and printed by an ink dispensing device associated therewith. This process may continue to additional printing heads for additional colors, some of these automatic textile printers being designed with as many as twenty printing stations for application of ten colors. For a ten color machine, ten printing heads would be provided and the platen assembly would typically be provided with twelve platens, ten for registration with printing heads, one for mounting of an article to be printed and one for removing an article on which printing has been completed. Thus, an article such as a shirt may be placed on the first platen and printed at the first printing head while another shirt is being placed on the next platen. Of course, this process can continue so than ten shirts are being printed with different colors at the same time.

One of the problems in printing an article with several colors is allowing for the ink deposited at one printing station to dry 2 "or cure" prior to printing another color on the article. In some cases, this problem has been solved by placing a heating device at adjacent print heads so that after an article is printed at one print head it moves to the adjacent print head for drying and then a third print head for the application of another color. However, if a textile article is dried at alternate printing heads it cannot be printed with another color. Thus, the number of colors capable of being applied to the shirt would be reduced. For example, with a ten head automatic textile printer, in which every other head were provided with a drying device, only five colors could be applied. Solutions to these problems are needed. Furthermore, instead of purchasing a five or six color printer for $25,000 the operator may have to purchase a ten color printer for $50,000.

Many printing machines use a pivotable printing head. When the print head pivots upwardly away from the platen, heat is rapidly dissipated away from the printing screen. These pivoting head printing machines do not require shielding to protect the printing screen from heat. Unfortunately, such pivoting head printing machines require complex mechanisms to suitably pivot the printing head. These complex mechanisms can lead to a lack of printing accuracy, extra expense, and more repair. However, if the printing head does not pivot, then any application of heat can damage the printing screen. As such, a need has developed for the use of a non-pivoting head which can avoid the problems associated with the damage to the printing screen and the drying of the ink caused by the application of heat.

SUMMARY OF THE PRESENT INVENTION

The present invention provides an improved method of printing, particularly useful with automatic textile printers which have a plurality of printing heads and a plurality of platens on which textile articles are placed for printing. In the method of the present invention, an article is placed on one of the machine platens which is then brought into registration with one of the machine printing heads and the platen and article are brought into contact with a printing screen supported at the printing head. Then the article is printed by engaging the printing screen with an ink dispensing device after which the platen and textile article are separated from the printing screen so as to leave a predetermined space therebetween. In the improved method of the present invention, a heating device is extended into the predetermined space and heat therefrom is directed away from the printing screen and toward the platen to cure the ink which has just been printed thereon. After curing, the heating device is retracted from the space leaving the platen and printed article thereon free to move to the next printing head where another color may be applied thereto and cured with another heating device. This process may be continued to subsequent printing heads until the requisite number of colors have been printed on the article. It is obvious that with this method, it is not necessary to skip any printing heads since ink from the previous head is cured before depositing of another color thereon.

Thus, the improved method of the present invention allows an automatic textile printer to be used at its full capacity and for the printing of a maximum number of colors without smearing or unwanted comingling of colors. The apparatus and method of doing so is relatively simple and especially cost effective. Many other objects and advantages of the invention will be apparent from reading the description which following in conjunction with the accompanying drawings.

DESCRIPTION OF A PREFERRED EMBODIMENT

Figure 1:
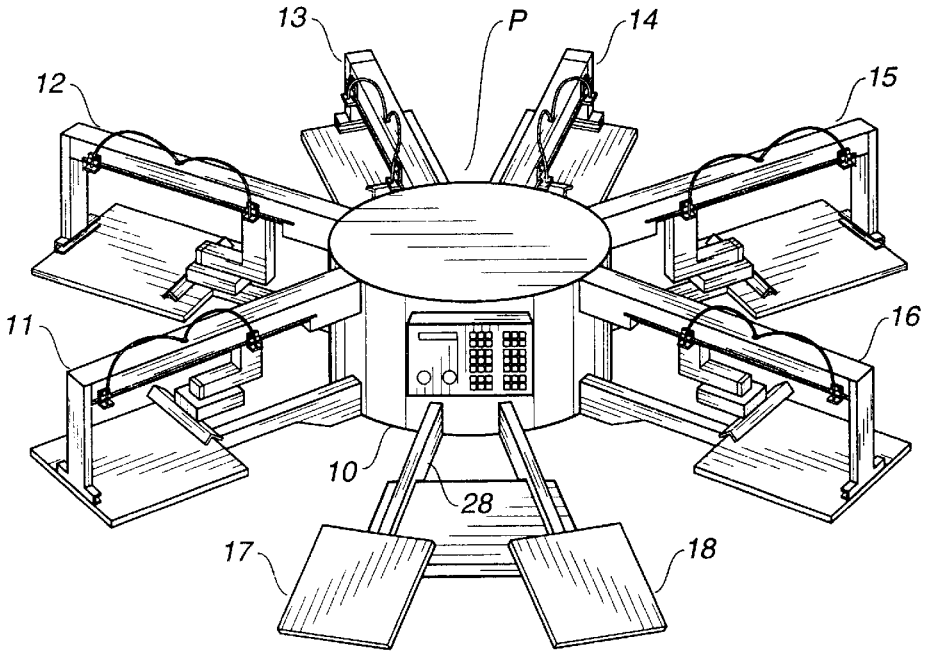
FIG. 1 PRIOR ART
FIG. 1 is a pictorial illustration of a multiple printing head, automatic textile printer of the prior art of the type with which the improved method of the present invention is particularly suitable.

Referring first to FIG. 1, there is shown an automatic textile printer P such as is available in the prior art. The automatic textile printer P may include a frame 10 about which is supported a plurality of printing heads 11, 12, 13, 14, 15, 16, six in the exemplary embodiment. Also supported on the frame 10 is a platen assembly which in the exemplary embodiment includes eight platens, one for each of the printing heads 11–16 (not shown) and two additional ones 17, 18. Although other machines may be arranged in different dispositions, the printing heads 11–16 and platen assembly, which includes platen 17 and 18 may be arranged in radial disposition. Typically, the platen assembly would be rotatable about a vertical axis so that upon rotation, say in a clockwise manner, the platen 17 would proceed to registration with printing head 11, then 12, then 13, then 14, then 15, then 16 and finally to the position of platen 18 in FIG. 1. Thus, a textile article could be placed on the platen 17 and rotated to each printing station for application of ink thereto in a method known in the prior art.

Figure 2:
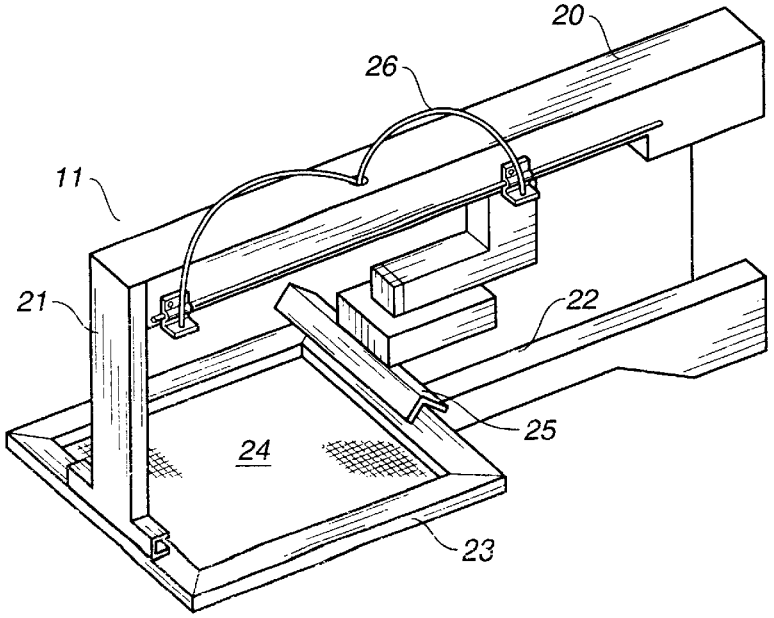
FIG. 2 PRIOR ART
FIG. 2 is pictorial illustration of the automatic textile printer of FIG. 1 showing one printing head thereof in greater detail.

Referring now also to FIG. 2, the printing heads, and specifically printing head 11, will be described in greater detail. The printing head 11 includes a cantilevered support 20 from which depends an outer screen support assembly 21 and an inner screen support assembly 22. These screen support assemblies 21, 22 are designed to support a printing screen which typically has a wooded frame 23 supporting a screen mesh 24 in which a print pattern is inscribed in a fashion known in the art. Supported on the cantilevered support 20 above the printing screen is an ink dispensing device or squeege 25. The ink dispensing device 25 may be supplied through an ink conduit, 26 by a supply source of ink (not shown) carried on the machine.

Various mechanical or electromechanical power devices are provided for moving the platen assembly, the ink dispensing device 25, etc. Various valves and pumps are provided for power devices and for controlling the flow and dispensing of ink from the ink device 25. All of these devices and operations may be controlled from a control console 19 (see FIG. 1) which may include a programmable computer for initiating events in printing as required.

Figure 3:
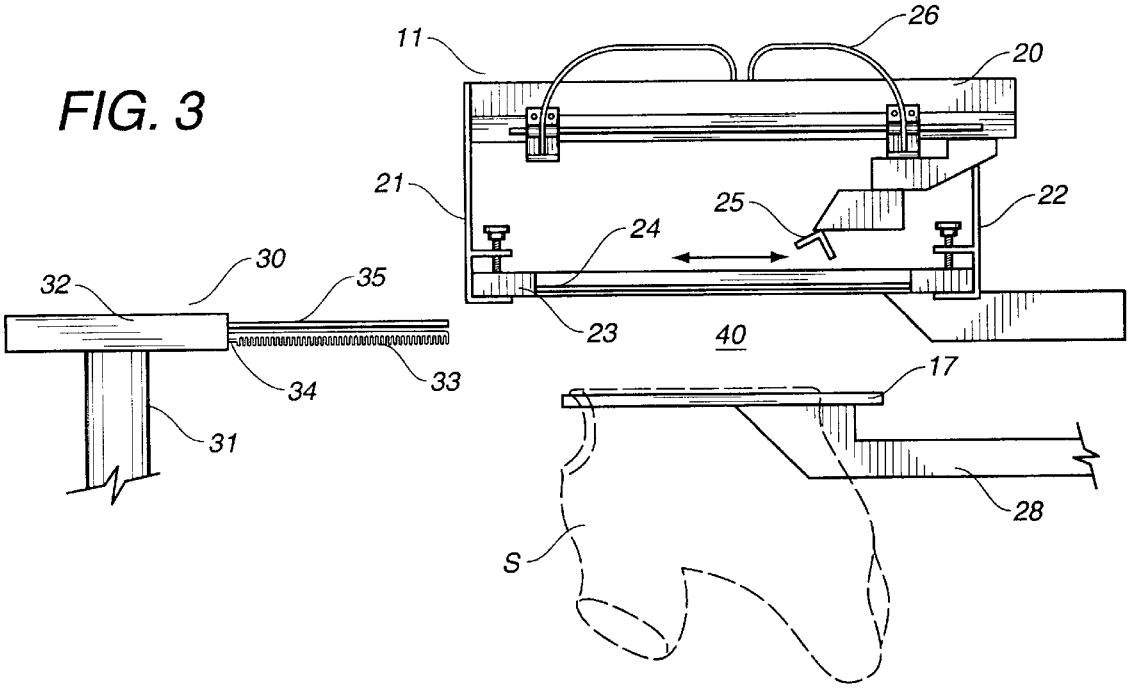
FIG. 3 is a schematic elevational view of one printing head and platen of an automatic textile printer, such as the printing head and platen of FIG. 2, depicting additional apparatus for performing the improved method of the present invention, according to a preferred embodiment thereof.
Figure 4:
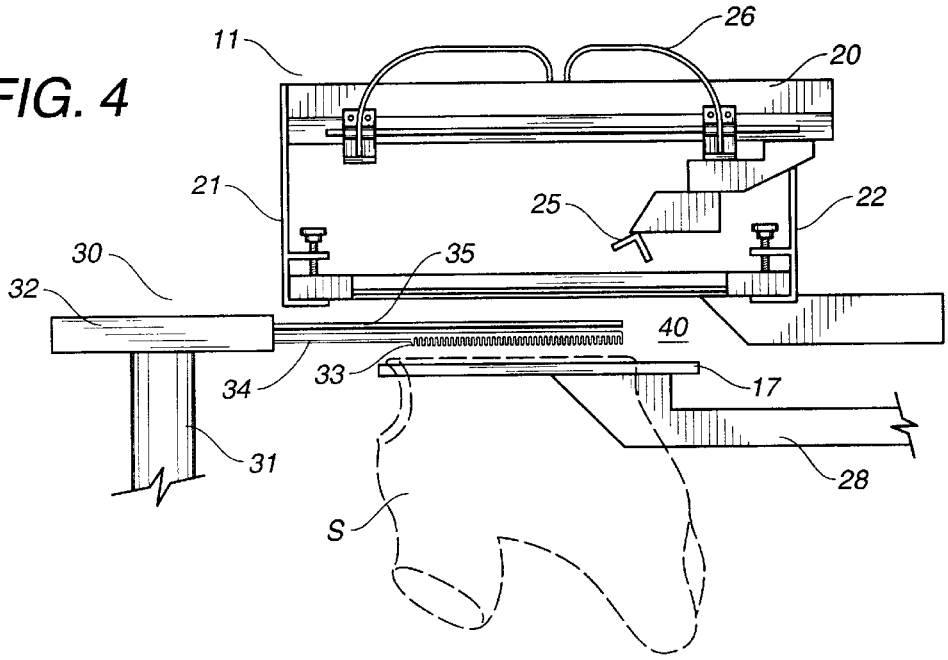
FIG. 4 is a schematic elevational view of the printing head and platen of FIG. 3 and the additional apparatus thereof at different steps of the method of the present invention, according to a preferred embodiment thereof.

Referring now to FIGS. 3 and 4, printing head 11 is shown with its cantilever arm 20, screen supports 21, 22 supporting a printing screen 23, 24 with the ink dispensing device 25 thereabove. Directly below the printing head 11 is shown one platen 17 of the platen assembly. The platen 17 is supported on the end of an arm 28 which projects radially to an inner portion of the platen assembly (not shown).

Radially outward of the printing head 11 is a heating device 30 which in the exemplary embodiment includes a support member 31, a hydraulic clinder 32 and a heating element 33 (infrared, quartz, etc.). The heating element 33 is actually attached to one end of a rod 34 at the opposite end of which is a piston (not shown) carried within the cylinder 32 for hydraulic reciprocation therein. The heating element 33 would be connected to a source of electricity (not shown) and the hydraulic piston and cylinder 32 would be connected to a source of pressurized fluid (not shown). Of course the heating device 30 could be designed in a number of ways. It might be powered by pneumatiac or electrical devices. The hydraulic one shown is simply for the purposes of illustrating the method of the present invention. The most important thing to remember is that the heating device 30 is capable of extending the heating element 33 into the space 40 between platen 17 and the printing screen 23, 24 such as shown in FIG. 4, and for retracting it to the position shown in FIG. 3.

Referring now to all the drawings, the method of printing of the present invention will be described for printing a textile article. Initially the textile article, such as a shirt S, is placed on a platen 17, preferably with platen 17 disposed as in FIG. 1 without interference from printing heads 11–16. Then the platen 17 would be moved (rotated in the exemplary embodiment) to a position in registration with printing head 11, such as shown in FIGS. 3 and 4. Then the platen 17 and shirt S would be brought into contact with the printing screen 23, 24. With the machine of the exemplary embodiment, this is done by raising the platen 17 to close the space 40. In some cases, the platen 17 may be stationarily maintained while the printing head 11 is lowered.

With the platen 17 and shirt S in contact with the printing screen 23, 24, the ink dispensing device squeege 25 would be brought into contact with the screen mesh 24 and wiped across the mesh 24, perhaps in both directions as indicated by the double-headed arrow, as it deposits ink through the pattern thereon for transfer to the shirt S. Then the ink dispensing device 25 would be deactuated and the platen 17 and shirt S separated form the screen 23, 24 to leave the predetermined space 40 therebetween.

The steps just described are known in the prior art. However the improved method of printing of the present invention includes additional steps performed by the heating device 30. After separation of the platen 17 and shirt S from the printing screen 23, 24 the piston and cylinder 32 would be actuated causing the heating device or element 33 to be extended into the space 40, as shown in FIG. 4. The heating element 33 would be actuated and preferably shielded by heat shield 35 from the screen 23, 24, directing heat toward the platen 17 to dry or cure the ink printed on the shirt S, typically five or six seconds. Next, the heating element 33 would be retracted from the space 40, returning to the position of FIG. 3.

After the heating element 33 is retracted, the platen assembly may be actuated rotating platen 17 to the next printing head 12 where the same process may be repeated with a different color application. The sequence continues with the platen 17 rotating to printing heads 13, 14, 15 and 16 and finally to the location depicted by platen 18 in FIG. 1 where the printed article or shirt may be removed. Of course as the shirt on platen 17 is being printed at printing head 11, another shirt may be placed on platen 18 and subsequent platens for sequential printing at each printing head 11–16.

As can be easily understood, the improved printing method of the present invention allows all of the printing heads 11–16 to be utilized by curing of ink before another application of ink so that there is no smearing or comingling of colors. The resulting printing on the article is clear and well defined. Production speed is not diminished and the operator does not have to decline jobs of many colors. Neither is it necessary to buy an expensive, many head machine, with alternate drying positions, when a less expensive less number of heads machine may be adequate.

While apparatus of a single embodiment has been described herein, it is understood that many variations of this apparatus and other types of apparatus may be utilized in performing the improved method of printing of the present invention. In addition, it should be understood that while the exemplary method of the invention has been described in printing textile articles, the method may also be used for paper, plastics and any other material on which printing may be needed. Accordingly, it is intended that the scope of the invention be limited only by the claims which follow.

I claim:

1. An improved method of printing an article with a machine having at least one non-pivoting printing head at which is supported a printing screen, the machine having an ink dispenser adapted for engagement with the printing screen, the machine further having at least one platen registerable with said printing head, the machine further including a heater and a heat shield, said method comprising the steps of: placing an article on said platen; bringing said platen and said article thereon into registerable contact with said printing screen; printing said article by engaging said printing screen with said ink dispenser and vertically separating said platen and said article from said printing screen to leave a predetermined vertical space therebetween; the improvement comprising the additional steps of:

extending said heater into said vertical space;

extending said heat shield through an area between said heater and said printing head;

directing heat from said heater toward said platen to cure the ink printed on said article; and retracting said heater form said vertical space.

2. The improved printing method of claim 1 including the further steps of moving said platen out of registration with said printing screen and performing other printing operations on said article.

3. The improved printing method of claim 1 in which said machine has a plurality of said printing heads and said platen comprises a plurality of platens, said plurality of platens being movable so that each of said plurality of platens may be sequentially registered with each of said printing heads and adapted to be brought into contact with a printing screen supported at one or more of said printing heads, said heater including a plurality of heaters each one of which is associated with a corresponding one of said printing heads, each of said heaters being retracted as said platens are sequentially moved between adjacent printing heads and during contact thereof with said printing screen but extendable into vertical spaces created after vertical separation of said platens and said printing screens to cure ink printed on articles placed on said platens.

4. An improved method of printing with a machine having a frame about which is radially supported a plurality of printing heads, each one of said plurality of printing heads each non-pivotably supporting a printing screen for engagement with an ink dispenser, and on which is carried adapted a plurality of platens which are rotatingly and sequentially moveable into registration with selected ones of said printing heads said machine having a heater and a heat shield, said method comprising the steps of: placing an article on at least one of said platens; bringing said one platen and said article into registration with one of said printing heads and into contact with the printing screen supported thereby; printing said article by engaging said printing screen with said ink dispenser and vertically separating said platen and said article from said printing screen to leave a predetermined vertical space therebetween; the improvement comprising the additional steps of:

radially extending said heater into said vertical space;

extending said heat shield into an area between said heater and said printing screen; and directing heat away from said printing screen and toward said platen to cure an ink printed on said article.

5. The improved printing method of claim 4 including the additional steps of:

radially retracting said heater from said space;

moving said one platen and said ink cured article into registration with another of said printing heads and into contact with another printing screen supported thereby;

printing said ink cured article with additional printing by engaging said another printing screen with another ink dispenser; and vertically separating said platen and said article from said another printing screen to leave another predetermined vertical space therebetween.

6. The improved printing method of claim 5 including the additional steps of:

radially extending said heater into said another vertical space between said platen and said another printing screen; and directing heat away from said another printing screen and toward said platen to cure the additional ink printed on said article.

7. The improved printing method of claim 6 including the additional steps of:

radially retracting said heater from said another vertical space; and printing said article with still additional printing by repeating the steps of claims 6 and 7 at one or more additional printing heads.

* * * * *